US008104734B2

(12) United States Patent
Stover

(10) Patent No.: US 8,104,734 B2
(45) Date of Patent: Jan. 31, 2012

(54) FENCE POST MOUNTING DEVICE

(76) Inventor: Brian K. Stover, New Hope, PA (US)

( * ) Notice: Subject to any disclaimer, the term of this patent is extended or adjusted under 35 U.S.C. 154(b) by 182 days.

(21) Appl. No.: 12/383,932

(22) Filed: Mar. 30, 2009

(65) Prior Publication Data

US 2010/0243975 A1 Sep. 30, 2010

(51) Int. Cl.
*F16M 13/00* (2006.01)
*E04H 17/00* (2006.01)

(52) U.S. Cl. ..... 248/519; 248/523; 248/218.4; 256/65.01; 256/65.02; 256/65.14; 52/165

(58) Field of Classification Search ..... 248/516, 248/519, 530, 545, 146, 156, 215, 518, 523, 248/218.4; 256/13.1, 19, 21, 22, 58, 65.02, 256/66, 59, 65.01, 65.14; 52/155, 165, 156, 52/169, 741.14, 749.1, 169.9
See application file for complete search history.

(56) References Cited

U.S. PATENT DOCUMENTS 4,540,160 A * 9/1985 Zanavich et al. ..... 256/19
5,149,060 A * 9/1992 Boes ..... 256/21
5,150,885 A * 9/1992 Leone ..... 256/22
5,152,507 A * 10/1992 Lee ..... 256/13.1
5,297,677 A * 3/1994 Burian et al. ..... 206/362.4
5,722,205 A * 3/1998 Gannaway ..... 52/155
5,806,758 A * 9/1998 Erwin et al. ..... 232/39
5,816,554 A * 10/1998 McCracken ..... 248/519
6,948,283 B2 * 9/2005 Burkart et al. ..... 52/155

* cited by examiner

*Primary Examiner* — Tan Le
(74) *Attorney, Agent, or Firm* — Armand M. Vozzo, Jr.

(57) ABSTRACT

An improved fence post mounting device is disclosed for supporting accessory articles upon a hollow fence post. The device comprises a cap member sized to fit over and upon the open top of the hollow fence post as a cover therefor, an elongated shaft member attached to the inside of the cap member and extending lengthwise therefrom to engage the chamber of the post, and support means coupled to the top of the cap member for holding or hanging the decorative accessories. In one preferred embodiment, the shaft member is fabricated having a pair of flanges formed on opposite sides of an intermediate web to provide a substantially "H" transverse cross section designed to fit closely within the chamber of a rectangular fence post while the full length of the shaft member is able to penetrate the post a sufficient length to allow a sealed fit of the cap member with the top of the post. Proper orientation of the shaft member and its transverse cross section allows the shaft member to fully penetrate the post chamber without interference with lateral rail connections made with the post and interlocks the assembly for proper mounting support.

9 Claims, 6 Drawing Sheets

FIG. 7
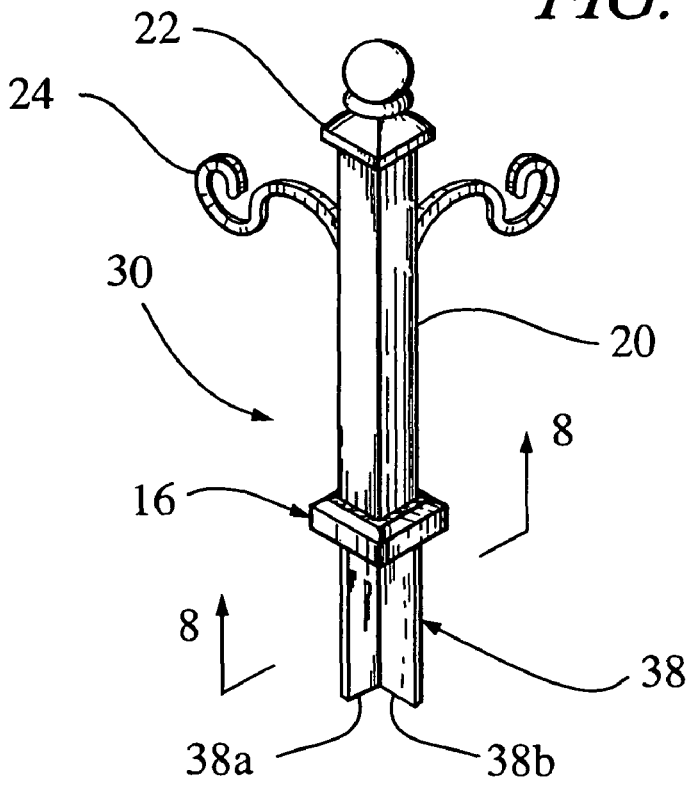
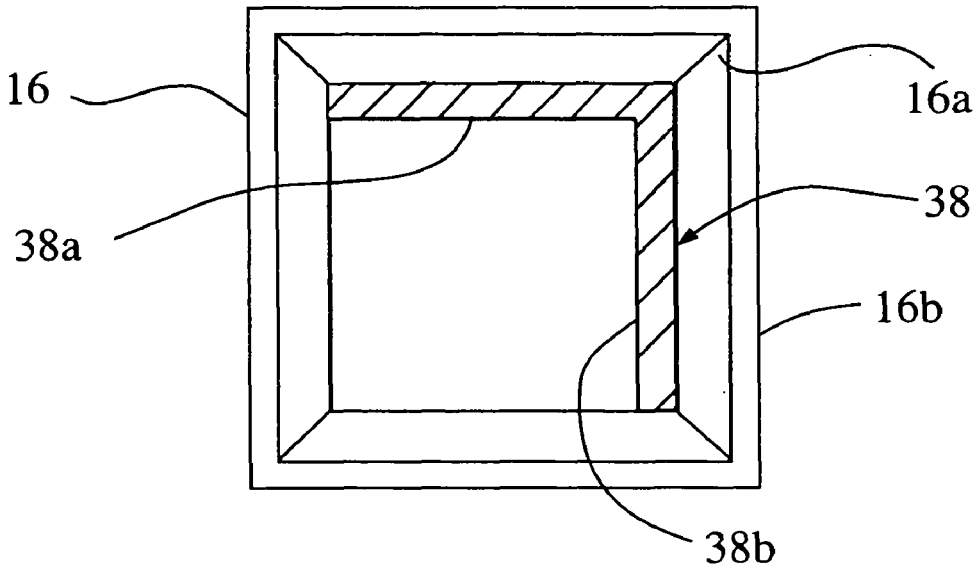
FIG. 8

FENCE POST MOUNTING DEVICE

BACKGROUND OF THE INVENTION

The present invention relates generally to support devices for mounting articles upon erected fence structures, and more particularly to an improved support device useful as a fencing accessory for mounting articles upon a hollow fence post with effective weight distribution throughout the post and without interfering with lateral rail connections in place upon the post.

Fencing has traditionally been used to define land boundaries and confine certain land areas requiring restricted passage. Historically made of solid wood materials formed into post members that are spaced apart and stationed in upright positions assembled together with associated rail members that are laterally arranged and connected between successive posts, fencing construction has recently turned to more durable materials, such as metals and plastics, to build and erect fencing systems that are stronger, longer lasting and generally more economical than their wooden counterparts. The post and rail members constructed of these alternative metals and plastics are typically formed having a hollow configuration, often being either rectangular or circular in their cross section, with the posts, because of their upright disposition, being required to have an end cap for sealing the open tops of the respective posts in the fence. Made accordingly to cover and close the open top of the hollow fence post, these end caps have further come in a variety of ornamental designs and provide the assembled fence with an attractive, uniform appearance.

While these ornamental end caps have for the most part been effective in sealing the tops of the hollow fence posts and providing an aesthetically pleasing look to the overall fence construction, they have not generally been capable of providing additional structural support for mounting decorative articles and other items of a landscaping nature upon the fence post. Some prior art fence post supports of this type have been devised, such as those shown and described in U.S. Pat. No. 5,332,196 to Wright for a Fence Post End Cap and in U.S. Pat. No. 6,216,886 to Considine for a Post-Mounted Hanging Device. While these and other prior art fence post support devices have been designed for mounting or hanging of articles in connection with standing fence posts, including those of hollow configuration, the structural features of these prior art devices have been somewhat complicated in their fitted coupling to the fence post and have been specifically designed to fit those standing fence posts that are erected alongside of the intermediate fencing material, be it the Cyclone® fencing in the aforestated Wright patent or the wooden beam and plank fencing in the aforestated Considine patent, rather than those hollow fence posts widely used today that are made and erected to directly engage and hold a plurality of lateral rail members within the walls of the fence post on opposite or contiguous sides thereof. The prior art fence support devices do not afford the effective fitted engagement of these types of hollow fence posts intended to engage and hold lateral rail members in the assembled fence construction, and accordingly, there is a need for an improved fence post mounting device that will effectively allow mounting or hanging of decorative articles and other ornamental objects upon such a hollow fence post member without interfering with or being obstructed by its lateral rail connections.

SUMMARY OF THE INVENTION

Accordingly, it is a general purpose and object of the present invention to provide an improved fencing accessory for mounting articles upon a standing fence post hollow in form and fitted to hold rail members laterally within the walls of the post.

A more particular object of the present invention is to provide an improved fence post mounting device for supporting decorative articles and ornamental objects upon a hollow fence post having a plurality of lateral rails held in place along side walls of the fence post without interfering with the lateral rails in place.

Another object of the present invention is to provide an improved fence post support device that easily attaches to a hollow fence post and is capable of supporting a variety of objects mounted upon the post with effective distribution of the weight throughout the post.

Still another object of the present invention is to provide a fence post mounting device further capable of retrofitting hollow fence post members standing in existing post and rail fencing systems so that articles may be firmly supported upon the post members without need for separate mechanical fasteners.

A still further object of the present invention is to provide an improved fence post mounting device that is relatively simple and inexpensive to manufacture, durable in its construction and reliable in its performance.

Briefly, these and other objects of the present invention are accomplished by an improved fence post mounting device for supporting accessory articles upon a hollow fence post. The device comprises an cap member sized to fit over and upon the open top of the hollow fence post as a cover therefor, an elongated shaft member attached to the inside of the cap member and extending lengthwise therefrom to engage the chamber of the post, and support means coupled to the top of the cap member for holding or hanging the decorative accessories. In one preferred embodiment, the shaft member is fabricated having a pair of flanges formed on opposite sides of an intermediate web to provide a substantially "H" transverse cross section designed to fit closely within the chamber of a rectangular fence post while the full length of the shaft member is able to penetrate the post a sufficient length to allow a sealed fit of the cap member with the top of the post. Proper orientation of the shaft member and its transverse cross section allows the shaft member to fully penetrate the post chamber without interference with lateral rail connections made with the post and interlocks the assembly for proper mounting support.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which:

FIG. 7 is a perspective view of the fence post mounting device of FIG. 6 separated from the fence post shown therein;

FIG. 8 is a cross sectional view of the fence post mounting device of FIG. 6 taken along the line 8-8 therein;

DETAILED DESCRIPTION OF THE INVENTION

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to appended claims.

Figure 1:
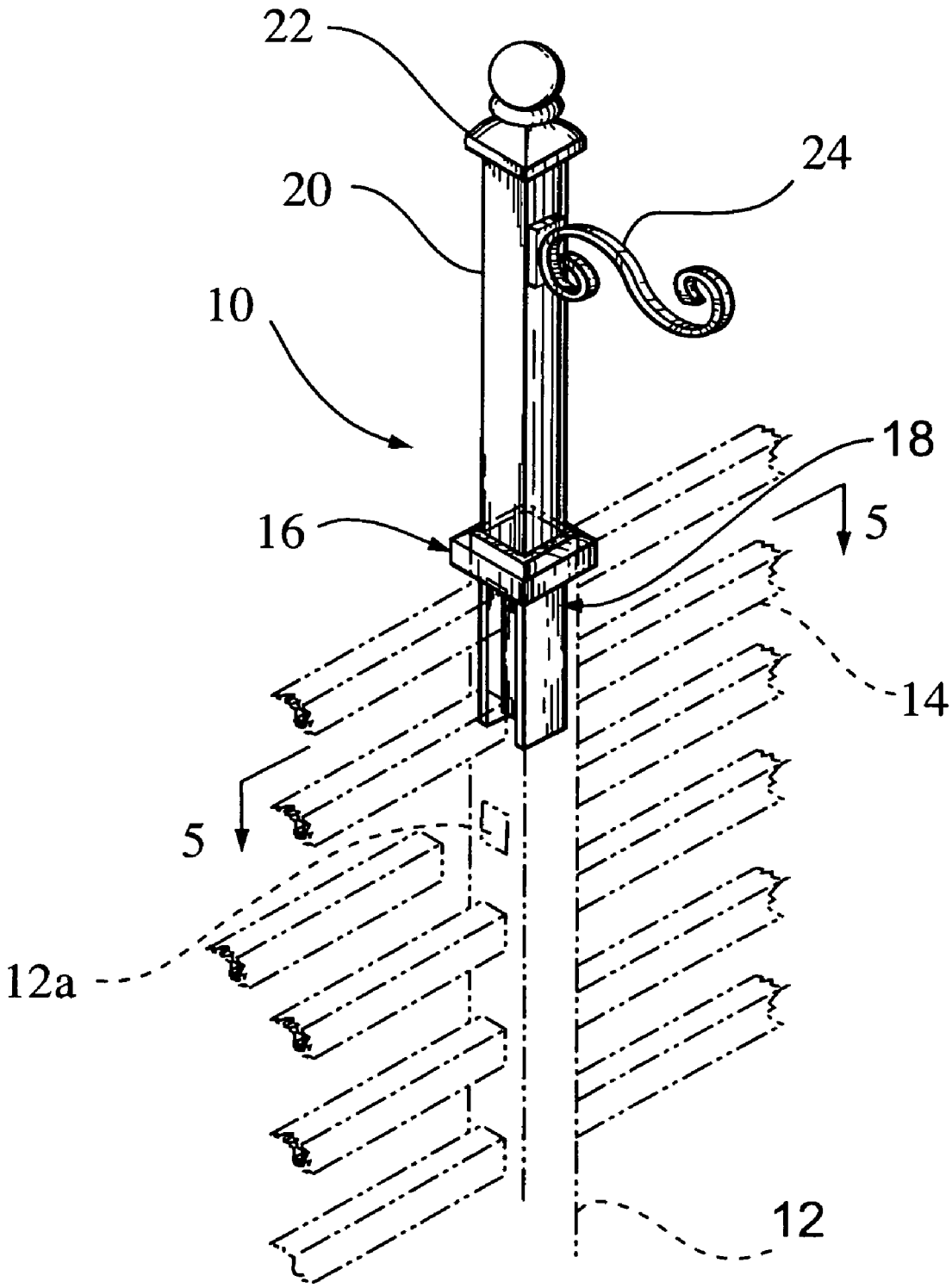
FIG. 1 is a perspective view of a preferred embodiment of a fence post mounting device constructed in accordance with the present invention and shown operatively engaged upon a hollow fence post erected with a plurality of lateral rail members engaging the post from opposite sides.

Referring now to FIG. 1, a fence post mounting device, generally designated 10, is shown in accordance with the present invention operatively engaged upon a hollow fence post 12 (shown in phantom outline) that is rectangular in form and erected in a typical standing position having a plurality of hollow rail members 14 (also in phantom) being laterally disposed and held in place on both sides of the post. In this type of hollow fence construction, typically made of an extruded aluminum material, the rails 14 are made to engage the side walls of the fence post 12 through openings 12*a* spaced apart in elevation along opposite sides of the post and formed to fit the end of each rail so that the rails may be secured in place within the walls of the post using a set screw or other conventional means of attachment. In this secured position of the rails 14 held within the openings 12*a* on both sides of the fence post 12, the ends of each rail customarily project into the chamber of the hollow fence post, as better seen in FIG. 5.

Figure 2:
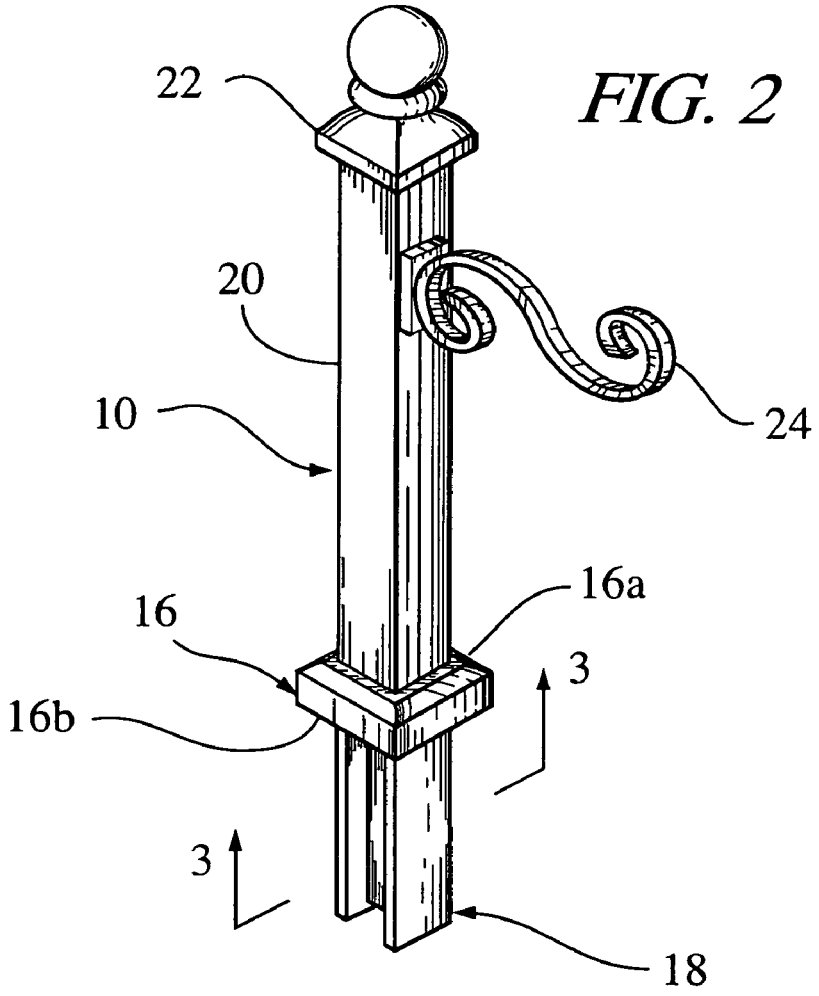
FIG. 2 is a perspective view of the fence post mounting device of FIG. 1 separated from the fence post shown therein.

Referring now to FIG. 2 in conjunction with FIG. 1, the present fence post mounting device 10 comprises a rigid cap member 16 formed to fit over and upon the open top of the hollow fence post 12 as a cover for its chamber. Preferably made from a lightweight metal, such as aluminum, or a plastic material, the cap member 16 is rectangular in its configuration having a substantially flat top surface with a beveled edge 16*a* on each side and a shoulder surface 16*b* depending therefrom about the perimeter of the cap member. The top surface of the cap member 16 with its beveled edges 16*a* is sized and shaped to set intimately upon and cover the open top of the fence post 12 with the depending shoulder surfaces 16*b* fitting closely about the outer walls of the fence post thereby serving to seal the open top and chamber thereof. An elongated shaft member 18 formed having a substantially "H" transverse cross section is attached to the underside of the cap member 16 in a central position beneath the top surface thereof and made to extend downwardly and perpendicularly therefrom so that the projection of the shaft member is maintained centrally within the perimeter of the cap member established by the outer shoulder surfaces 16*b*. The shaft member 18 is made from an aluminum material similar to that of the cap member 16 and is preferably extruded in its form, with attachment between the top of the shaft member and the underside of the cap member being effected best by welding. From its positioned attachment inside of the cap member 16, the shaft member 18 extends lengthwise substantially beyond the bottom of the shoulder surfaces 16*b*, projecting outwardly from beneath the cap member for engagement of the open chamber of fence post 12 and proper seating therein upon fitted closure by the cap member. The extended length of the shaft member 18 and its projection beneath the body of cap member 16 may vary, as described below, depending upon the size and weight of the accessory article intended for support upon the fence post 12 using the present fence post mounting device 10.

Figure 3:
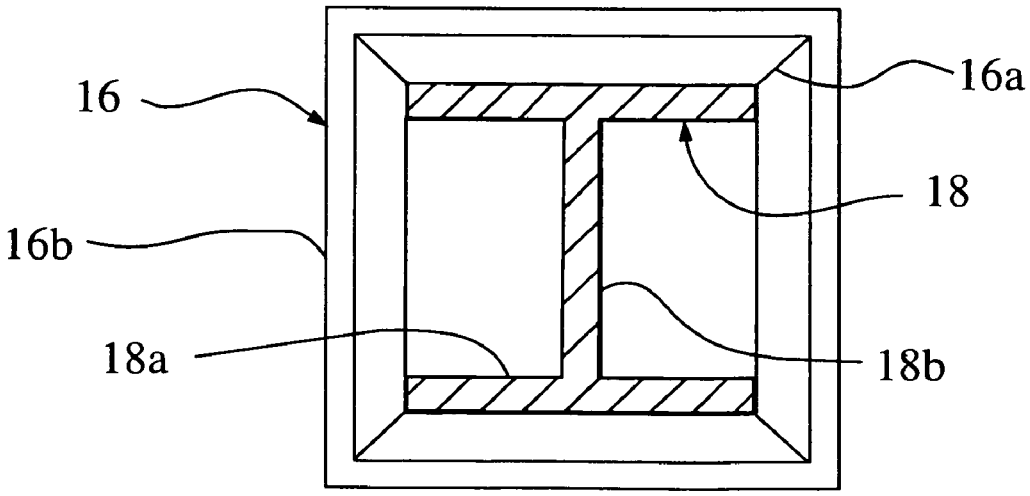
FIG. 3 is a cross sectional view of the fence post mounting device of FIG. 2 taken along the line 3-3 therein.
Figure 4:
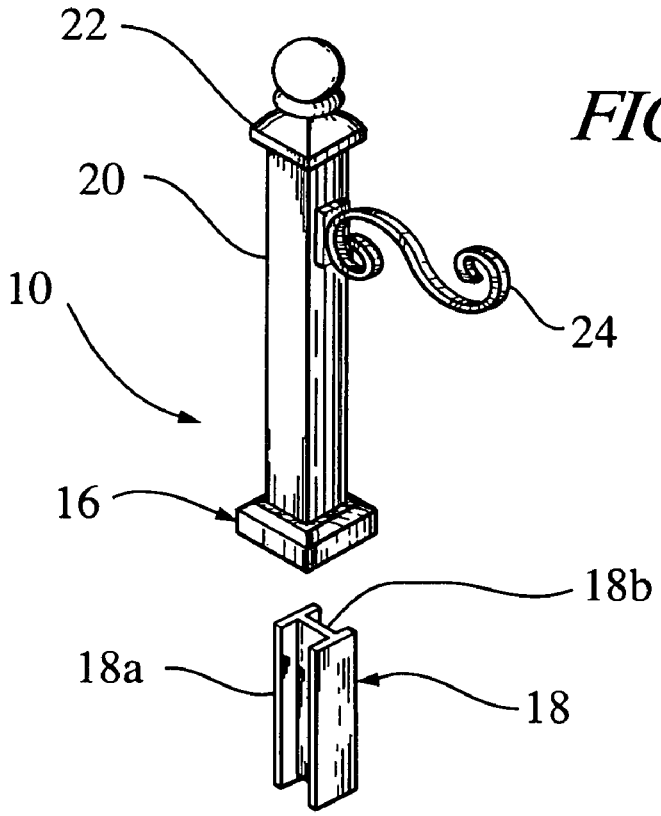
FIG. 4 is an exploded view in perspective of the fence post mounting device of FIG. 2.

Referring now to FIGS. 3 and 4 in conjunction with FIGS. 1 and 2, the shaft member 18 is fabricated along its length having a pair of outer flanges 18*a* formed on opposite sides of an intermediate web 18*b* extending perpendicularly therebetween to provide the shaft member with the substantially "H" transverse cross section. In this configuration, the shaft member 18 fits closely and abuts the edges of the rectangular chamber of the fence post 12 upon its engagement therewith, particularly along the sides and in the respective corners of the chamber abutting the outer flanges 18*a*. With the outer flanges 18*a* aligned in the direction of the rail members 14, the shaft member 18 is designed to insert longitudinally into the chamber of the fence post 12 with the extended projection of the shaft member beneath cap member 16 able to slide down into the post chamber its full length upon the intended closure of the top of the post by the cap member. It should be recognized and understood that the proper orientation of the shaft member 18 and its transverse cross section within the hollow fence post 12 allows the shaft member to mechanically interlock with the post chamber and thereby distribute the weight of a mounted accessory throughout the post, while at the same time, doing so without interference from lateral rail connections made with the post.

Figure 5:
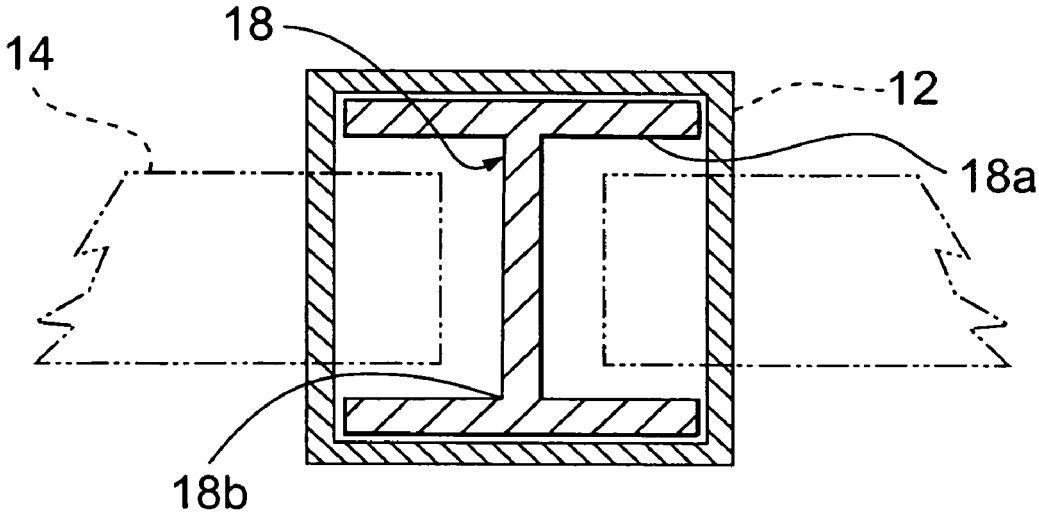
FIG. 5 is a cross sectional view of the present fence post mounting device in its operative engagement of FIG. 1 taken along the line 5-5 therein.

As best viewed in FIG. 5, the shaft member 18, despite its length, extends down into the fence post 12 and penetrates the post chamber without obstruction from the rail members 14 connected to the post along the opposite side walls thereof. Due to its transverse cross section, the full length of shaft member 18 bypasses the ends of each of the respective rails 14 that laterally engage and penetrate the side walls of the fence post 12 through the openings 12*a* therein, with each end of the rail members passing between the outer flanges 18*a* on either side of the intermediate web 18*b* of the shaft member. The length of shaft member 18 should extend sufficiently deep enough into the post chamber so that the transverse cross section of the shaft member, particularly its outer flanges 18*a*, maintains a firm abutting relationship with the walls of the chamber and the mechanical interlock that results. Beyond that length of the shaft member 18 deemed sufficient to effect the mechanical interlock, the shaft member may be made longer for added extension through the post chamber to provide needed support for heavier mounted accessories and those mounted or hung at higher elevations above the cap member 16.

Atop the cap member 16, the present fence post mounting device 10 further includes means for holding or hanging accessory articles including a post extender 20 attached directly atop the cap member and formed in size and shape similar to fence post 12, a crown cap 22 secured to the top of the post extender, and an ornamental hook member 24 fastened along one or more sides of the post extender and used to hold or hang a decorative article thereon. The post extender 20 is a rigid longitudinal member constructed from a material, such as aluminum, similar to that of the fence post 12 and is preferably made hollow in form like the fence post but with solid side walls along its length. The post extender 20 is rigidly attached at its bottom end to the top surface of the cap member 16 by conventional means and may vary in its length depending upon the length of the underlying fence post 12, the accessory article intended to be mounted thereon, and the elevation desired for the mounted article. The crown cap 22, ornamental in its configuration, is further formed in size and shape to fit and cover the top of the post extender 20 and thereby additionally serves to seal its chamber. The ornamental hook 24 is rigidly formed to engage a hanging article and fastened to the side wall of the post extender 20 to support its weight.

Figure 6:
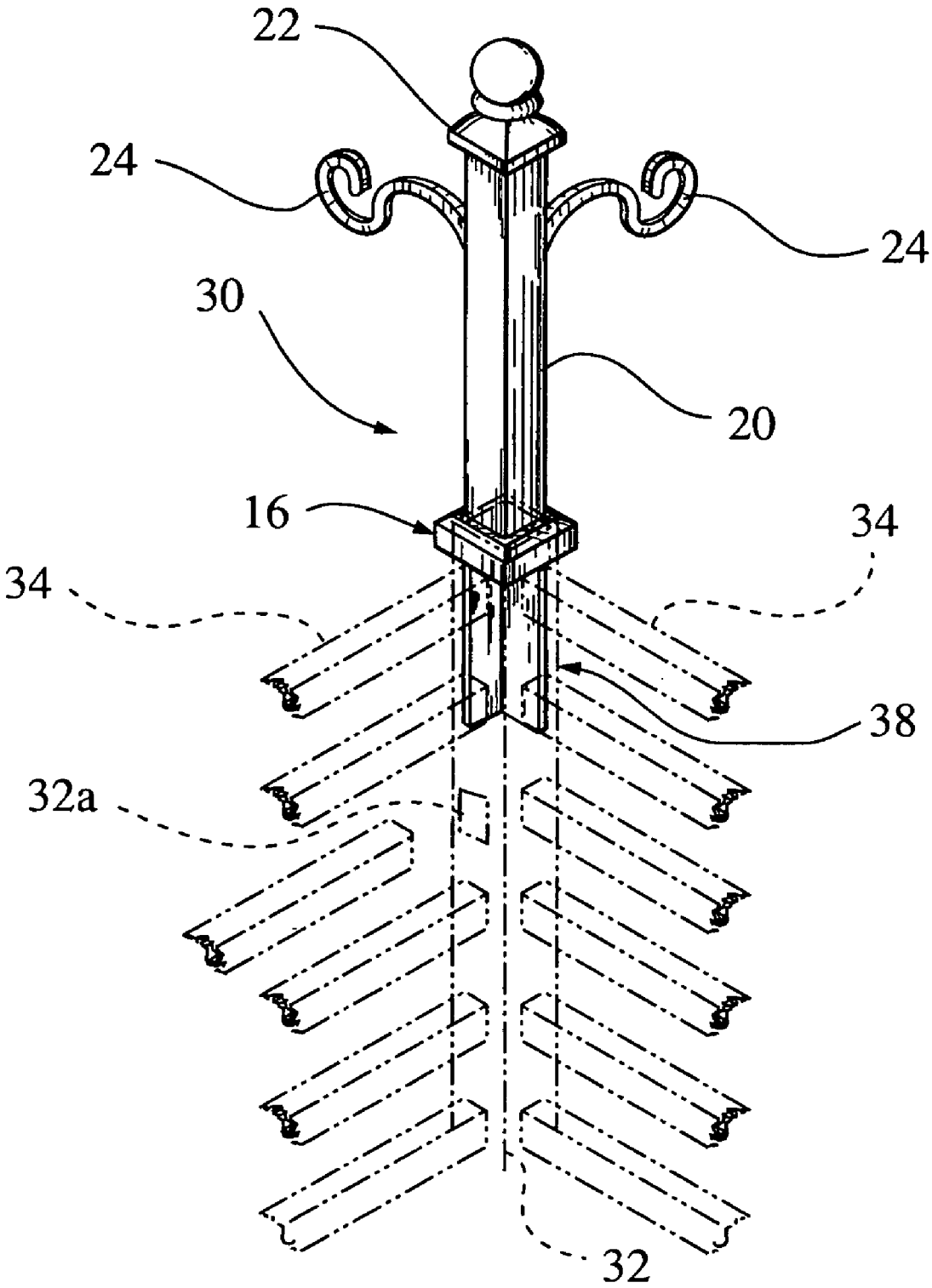
FIG. 6 is a perspective view of a second preferred embodiment of a fence post mounting device constructed in accordance with the present invention shown operatively disposed within a corner fence post erected with a plurality of lateral rail members engaging the post on a pair of contiguous sides.

Referring now to FIG. 6, a second embodiment of the present fence post mounting device, generally designated 30, is shown operatively engaged upon a hollow fence post 32 (shown in phantom outline) that is similarly rectangular in form and erected in standing position, like that of the fence post 12 described above, but instead employed as a corner post wherein a plurality of hollow rail members 34 (also in phantom) are laterally disposed and held in place on a pair of contiguous sides of the corner post. The rails 34 are rigid in construction and made of a durable, lightweight material, typically aluminum, each rail formed to engage the contiguous side walls of the corner post 32 through openings 32*a* made therein. The openings 32*a* are spaced apart in elevation along the contiguous side walls of the corner post 32 and are sized and shaped to fit the ends of the rails 34 so that the rails may be secured and held in place within the side walls of the corner post using a set screw or other conventional means of attachment. In their secured positions within the openings 32*a* on the contiguous sides of the corner fence post 32, the ends of the rails held on the respective sides project perpendicularly into the chamber of the corner fence post.

Referring now to FIGS. 7 and 8 in conjunction with FIG. 6, the fence post mounting device 30 for the corner post 32 comprises the same rectangular cap member 16, as described above, formed to fit over and upon the open top of the fence post as a cover for its chamber. Preferably fabricated from a lightweight metal, such as aluminum, the cap member 16 provides a substantially flat top surface with a beveled edge 16*a* on each side and shoulder surfaces 16*b* depending about the perimeter, the combined surfaces of the cap member serving to cover the open top of the corner post 32 and seal its chamber. In the present fence post mounting device 30, an elongated shaft member 38 having a substantially "L" transverse cross section is employed and attached to the underside of the cap member 16 beneath the top surface thereof, extending downwardly and perpendicularly therefrom so that the projection of the shaft member is maintained within the perimeter of the cap member established by the outer shoulder surfaces 16*b*. The shaft member 38 is fabricated from an aluminum material similar to that of the cap member 16 and is preferably extruded in its form, with a welded attachment being made between the top of the shaft member and the underside of the cap member. From its welded attachment inside of the cap member 16, the shaft member 38 extends lengthwise beyond the bottom of the shoulder surfaces 16*b*, projecting outwardly from beneath the cap member for engagement of the open chamber of the corner fence post 32 and a proper seating therein upon fitted closure by the cap member on the post. The extended length of the shaft member 38 and its projection beneath the body of cap member 16 can vary depending upon the size and weight of the accessory article intended for support upon the corner post 32 using the present fence post mounting device 30.

The shaft member 38 is fabricated having a pair of contiguous side walls 38*a*, 38*b* formed at a substantially right angle along the length thereof to provide the shaft member with the substantially "L" transverse cross section. In this configuration, the shaft member 38 is designed to fit closely and abut the interior walls of the rectangular chamber of the corner post 32 upon its engagement therewith, particularly with the contiguous side walls 38*a*, 38*b* being inserted into the corner of the post chamber away from the entering rails 34. With the contiguous side walls 38*a*, 38*b* oriented in this fashion, the shaft member 38 is inserted longitudinally into the chamber of the corner post 32 with the extended projection of the shaft member beneath cap member 16 able to slide down into the post chamber its full length. It should be noted that the proper orientation of the shaft member 38 and its transverse cross section within the corner fence post 32 allows the shaft member to mechanically interlock with the post chamber and thereby distribute the weight of a mounted accessory throughout the post, while at the same time, doing so without interference from the lateral rail connections made with the post. Due to its transverse cross section, the full length of shaft member 38 extends down into the corner post 32 and penetrates the post chamber without obstruction from the rail members 34 entering the post along its contiguous side walls on the opposite corner, the side walls 38*a*, 38*b* of the shaft member bypassing the ends of each of the respective rails 34. The length of shaft member 38 should extend sufficiently deep enough into the post chamber so that the transverse cross section of the shaft member, particularly side walls 38*a*, 38*b*, maintains a firm abutting relationship with the corner walls of the chamber and the mechanical interlock that results. The length of shaft member 38 may be increased for added extension through the post chamber to provide needed support for heavier mounted accessories and those mounted or hung at higher elevations above the cap member 16.

Atop the cap member 16, the corner fence post mounting device 30, similar to the first embodiment of the invention described above, further includes means for holding or hanging accessory articles including post extender 20 attached atop the cap member, a crown cap 22 secured to the top of the post extender, and one or more ornamental hook members 24 fastened along one or more sides of the post extender and used to hold or hang decorative articles thereon. The post extender 20, crown cap 22 and ornamental hooks 24 are the same as those described above with respect to the post mounting device 10 and are assembled and interconnected in the same fashion to provide means for supporting intended accessory articles upon the corner post 32 using the present embodiment of fence post mounting device 30.

Figure 9:
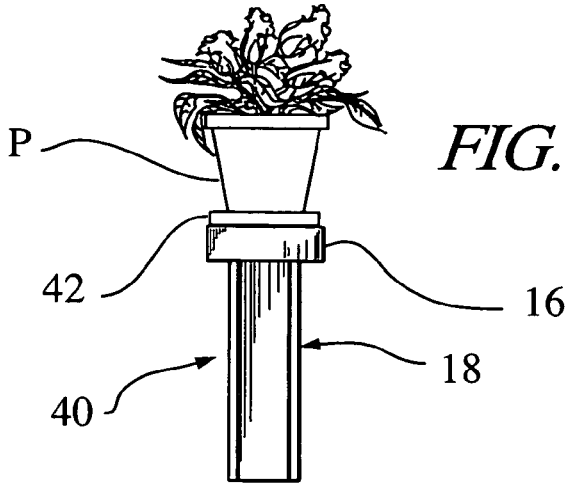
FIG. 9 is an elevation view of an alternate embodiment of the present fence post mounting device.
Figure 10:
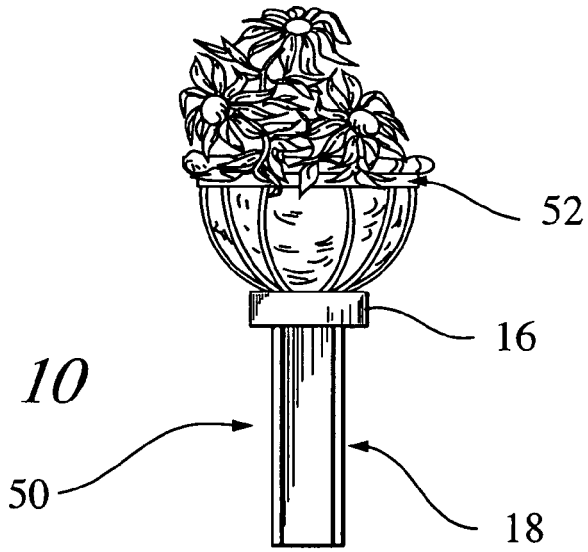
FIG. 10 is an elevation view of a further alternate embodiment of the present fence post mounting device.
Figure 11:
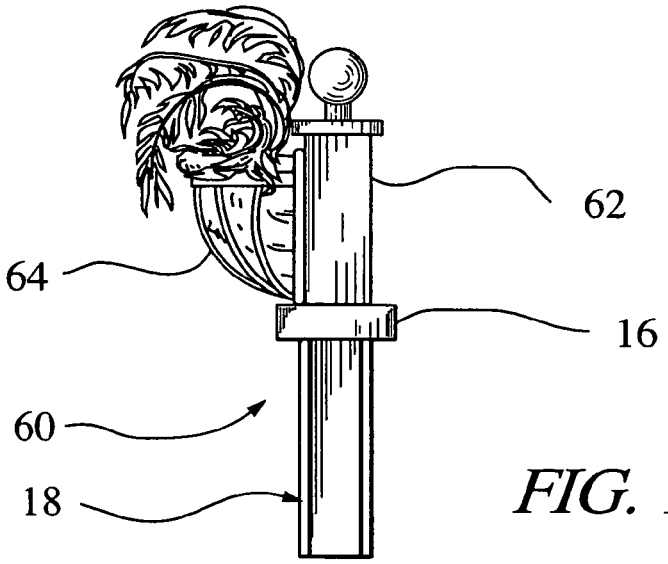
FIG. 11 is an elevation view of an additional alternate embodiment of the present fence post mounting device.

Other alternative versions of the present fence post mounting device, particularly with respect to the means atop the cap member 16 and elongated shaft 18 for hanging or holding accessory articles, are shown in FIGS. 9, 10 and 11. In FIG. 9, a fence post mounting device 40 in accordance with the present invention includes a tray or like open receptacle 42 formed to fit upon the cap member 16 for holding a potted plant P. In FIG. 10, a fence post mounting device 50 includes a conventional liner basket 52 that is adapted to fit the top of cap member 16 and be secured thereto for holding an arrangement of flowers. A modified version of a fence post mounting device 60 includes a post extender 62, similar to that described above, but with a half-sectioned liner basket 64 attached to the side of the post extender to display a flower arrangement.

Therefore, it is apparent that the described invention provides an improved fencing accessory for mounting articles upon a standing fence post hollow in form and fitted to hold rail members in lateral connections with the walls of the post. More particularly, the present invention provides an effective fence post mounting device that supports decorative articles and ornamental objects upon a hollow fence post bearing lateral rails without interfering with the lateral rails in place. The present fence post mounting device easily attaches to a hollow fence post and is further capable of supporting a variety of objects mounted upon the post with effective distribution of the weight throughout the length of the post but without obstruction from any existing lateral connections in place upon the post. In addition, the disclosed fence post mounting device is capable of retrofitting hollow fence post members standing in existing post and rail fencing systems so that articles may be firmly supported upon the post members without need for separate mechanical fasteners. Furthermore, the disclosed fence post mounting device is relatively simple and inexpensive to manufacture, durable in its construction and reliable in its performance.

Obviously, other embodiments and modifications of the present invention will readily come to those or ordinary skill in the art having the benefit of the teachings presented in the foregoing description and drawings. Alternate embodiments of different shapes and sizes, as well as substitution of known materials or those materials that may be developed at a future time to perform the same function as the present described embodiment are therefore considered to be part of the present invention. For example, the shape of the post extender 20 may be other rather than rectangular as shown and described. Accordingly, it is understood that this invention is not limited to the particular embodiment described, but rather is intended to cover modifications within the spirit and scope of the present invention as expressed in the appended claims.

What is claimed:

1. A fence post mounting device for supporting accessory articles upon a hollow fence post formed and erected having a chamber with one or more walls fitted to hold rail members laterally therethrough, comprising:

a cap member adapted to fit over and engage upon the top of the hollow fence post as a cover therefor;

an elongated shaft member attached to the inside of said cap member and extending lengthwise therefrom to longitudinally engage the chamber of the post, the length of said shaft member having an H-shaped transverse cross section comprising a pair of outer flanges formed on opposite sides of an intermediate web integrally formed therebetween to abut selected walls of the post chamber sufficient to mechanically interlock therewith out interference from rail members held in the chamber; and support means secured atop said cap member for holding the accessory articles.

2. A fence post mounting device according to claim 1, wherein the outer flanges of said shaft member are formed to fit and abut interior walls on opposite sides of the post chamber upon engagement of said shaft member therewith.

3. A fence post mounting device according to claim 2, wherein said cap member is formed having a substantially flat top surface sized and shaped to set intimately upon and cover the top of the fence post and a shoulder surface depending from the top surface about the perimeter thereof.

4. A fence post mounting device according to claim 3, wherein said support means comprises:

a longitudinal member attached at one end thereof to the top surface of said cap member and made to extend therefrom;

a crown cap member secured to the top of said longitudinal member; and a hook member fastened along one or more sides of said longitudinal member to hold accessory articles hung thereon.

5. A fence post mounting device for supporting accessory articles upon a hollow fence post of the type rectangularly formed and erected having a chamber with one or more walls fitted to hold rail members laterally therethrough, comprising:

a cap member rectangular in form and adapted to fit over and engage upon the top of the hollow fence post as a cover therefor;

an elongated shaft member attached to the inside of said cap member and extending lengthwise therefrom to longitudinally engage the chamber of the post, said shaft member comprising a pair of outer flanges formed on opposite sides of an intermediate web integrally formed therebetween to provide an H-shaped transverse cross section along the length of said shaft member to abut at least two selected walls of the post chamber without interference from rail members held in the chamber; and support means secured atop said cap member for holding the accessory articles.

6. A fence post mounting device according to claim 5, wherein the outer flanges of said shaft member are formed to fit and abut interior walls on opposite sides of the post chamber upon engagement of said shaft member therewith.

7. A fence post mounting device according to claim 6, wherein said cap member is formed having a substantially flat top surface sized and shaped to set intimately upon and cover the top of the fence post and shoulder surfaces depending from the top surface about the perimeter thereof.

8. A fence post mounting device according to claim 5, wherein said support means comprises:

a longitudinal member attached at one end thereof to the top surface of said cap member and made to extend therefrom;

a crown cap member secured to the top of said longitudinal member; and a hook member fastened along one or more sides of said longitudinal member to hold accessory articles hung thereon.

9. In a hollow fence construction of the type wherein a fence post hollow in form is erected having a chamber with one or more walls fitted to hold rail members laterally therein, the improvement comprising:

a cap member adapted to fit over and engage upon the top of the hollow fence post as a cover therefor;

an elongated shaft member attached to the inside of said cap member and extending lengthwise therefrom to longitudinally engage the chamber of the post, said shaft member having an H-shaped transverse cross section and comprising a pair of outer flanges formed on opposite sides of an intermediate web integrally formed therebetween, the outer flanges of said shaft member being formed to abut selected walls on opposite sides of the post chamber sufficient to mechanically interlock therewith out interference from rail members held in the chamber; and support means secured atop said cap member for holding accessory articles.

* * * * *